US006621396B2

(12) United States Patent
Leupold

(10) Patent No.: US 6,621,396 B2
(45) Date of Patent: Sep. 16, 2003

(54) PERMANENT MAGNET RADIAL MAGNETIZER

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 6 days.

(21) Appl. No.: 10/055,391

(22) Filed: Jan. 23, 2002

(65) Prior Publication Data

US 2002/0097121 A1 Jul. 25, 2002

Related U.S. Application Data

(63) Continuation of application No. 08/637,882, filed on Apr. 25, 1996, now abandoned.

(51) Int. Cl.[7] ..... H01F 7/02; H01F 13/00

(52) U.S. Cl. ..... 335/306; 335/284

(58) Field of Search ..... 335/302–306, 335/284

(56) References Cited

U.S. PATENT DOCUMENTS 4,859,976 A * 8/1989 Leupold ..... 335/306

* cited by examiner

*Primary Examiner*—Ramon M. Barrera
(74) *Attorney, Agent, or Firm*—Michael Zelenka; George B. Tereschuk

(57) ABSTRACT

A permanent magnet radial magnetizer is provided for use in radially magnetizing a workpiece ring. This magnetizer includes a lower magic hemisphere and an upper magic hemisphere which have respective equatorial surfaces in oppositely facing relationship to form a gap wherein a work-piece ring can be radially magnetized. Toroidal flux and pathways pass in the magnetizer and a portion of each such pathway passes through a spherical cavity therein, between one of the hemispheres and the gap.

7 Claims, 1 Drawing Sheet

PERMANENT MAGNET RADIAL MAGNETIZER

The Application is a Continuation of application Ser. No. 08/637,882 filed Apr. 25, 1996. Application Ser. No. 08/637, 882 is to be abandoned immediately after a Ser. No. is assigned to the Application by the PTO.

GOVERNMENT INTEREST

The invention described herein may be manufactured, used, imported, sold, and licensed by or for the Government of the United States of America without the payment to me of any royalty thereon.

CROSS-REFERENCE

A related application by the same inventor is U.S. Patent Office application Ser. No. 8/664,366 which was subsequently issued as U.S. Pat. No. 5,666,097 on Sep. 9, 1997.

FIELD OF THE INVENTION

The invention generally relates to magnet design and fabrication, and in particular the invention relates to a permanent magnet radial magnetizer which has a lower magic hemisphere and an upper magic hemisphere with a gap there between in which a ring shaped workpiece can be radially magnetized.

BACKGROUND OF THE INVENTION

In the state of the art, radially magnetized rings are used for applications such as traveling wave tubes, klystrons, and the like. Typically, high coercivity permanent magnets of toroidal or disk-like shape are difficult to magnetize radially. The difficulty arises for toroidal magnets because the thickness of the magnet is too large thus preventing sufficient flux from flowing into the toroidal hole which can then spread radially outward. This problem is discussed in U.S. Pat. No. 4,592,889 and in a U.S. Government Technical Report DELET-TR-84-5 ERADCOM 1984.

U.S. Pat. No. 4,592,889 further describes a method and apparatus for pressing and aligning radially oriented toroidal magnets. The prior art magnetizer described in U.S. Pat. No. 4,592,889 includes a magnetic flux producing means having two opposing electrical coils, two electrical insulators for embedding the coils, and a yoke member for holding a workpiece to be magnetized radially.

One problem with the prior art magnetizer is that it requires a relatively high capacity power supply.

As noted in the above report, an aligning field of 2–4 kilooersteds (kOe) is sufficient for alignment of the constituent magnetic powders during fabrication. However, a larger field is required to achieve complete magnetization. In the prior art magnetizer, described in U.S. Pat. No. 4,592, 889, a high-current, opposing-coil impulse-magnetizer was used to provide nearly 10 kOe of field. However, a significant drawback of this prior art magnetizer is that it requires a current source of thousands of amperes (amps) capacity, as well as two opposing electrical coils of a plurality of winding which must be embedded in a relatively strong electrical insulator to hold the coil structure together. A metal case must also be used to provide additional strength and safety to the coil structures.

SUMMARY OF THE INVENTION

Accordingly, it is an object of the present invention to provide a permanent magnet radial magnetizer that produces sufficient flux to radially magnetize a toroidal ring magnet and which does not require a high-capacity power supply.

This and other objects of the invention are achieved by a compact permanent magnet structure of magnetically opposing hemispheres with a central cavity to produce a uniform high field within the cavity for radially magnetizing toroidal ring magnets. A hemisphere is a hemispherical flux source. Briefly, a permanent magnet radial magnetizer according to the principles of the invention includes a lower hemisphere having an axis, an upper hemisphere coaxially aligned with and mounted in opposition to said lower hemisphere, said lower hemisphere and said upper hemisphere each having an equatorial surface forming a gap therebetween in which a ring shaped workpiece can be radially magnetized, said lower hemisphere and said upper hemisphere each having an inner surface which forms a spherical cavity in which an iron fill material may be disposed, and said lower hemisphere and said upper hemisphere each having a flux line pathway comprising an axial and a radial flux component within said cavity.

The use of a lower hemisphere and an upper hemisphere having respective flux pathways with coacting radial flux components avoids the problem of requiring a relatively high capacity power supply to produce a high capacity current.

BRIEF DESCRIPTION OF THE DRAWINGS

The foregoing and other objects, features and advantages will be apparent from the following Detailed Description of the Invention as illustrated in the accompanying drawings, wherein.

DETAILED DESCRIPTION OF THE INVENTION

Figure 1:
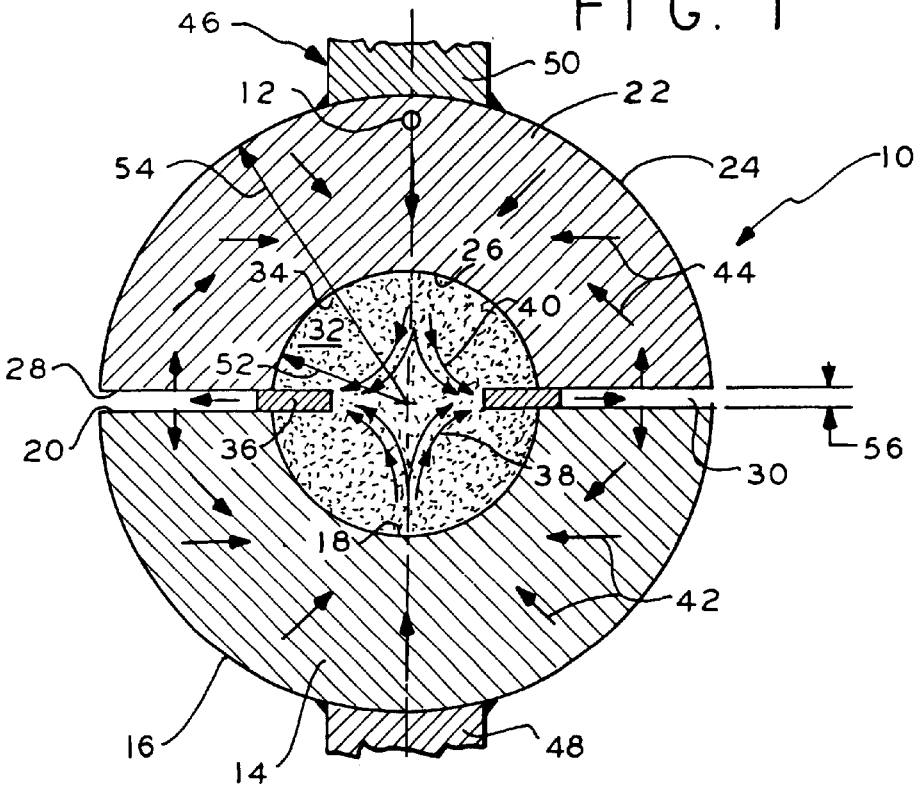
FIG. 1 is a vertical sectional view of a permanent magnet radial magnetizer according to the present invention.

As shown in FIG. 1, a magnetizer structure or magnetizer or assembly 10 is provided. Assembly 10 is a relatively compact permanent magnet structure which does not require a high capacity power supply. Assembly 10 has a vertical axis of symmetry or axis 12. Assembly 10 has a lower hemisphere 14, which has an outer spherical surface 16 and an inner spherical surface 18 and a lower joint or equatorial surface 20, as is derived in FIG. 1 from the circular planar surface that exists between the outer spherical surface and the inner spherical surface 18. Assembly 10 has an upper hemisphere 22, which has an outer spherical surface 24 and an inner spherical surface 26 and an upper joint or equatorial surface 28, as is derived in FIG. 1 from the circular planar surface that exists between the outer spherical surface 24 and the inner spherical surface 26. Hemispheres 14, 22 are permanent magnets of some high energy product rigid magnetic material (e.g., $SmCo_5$, $Sm_2$, $Co_{17}$, NdFeB, etc.).

Figure 2:
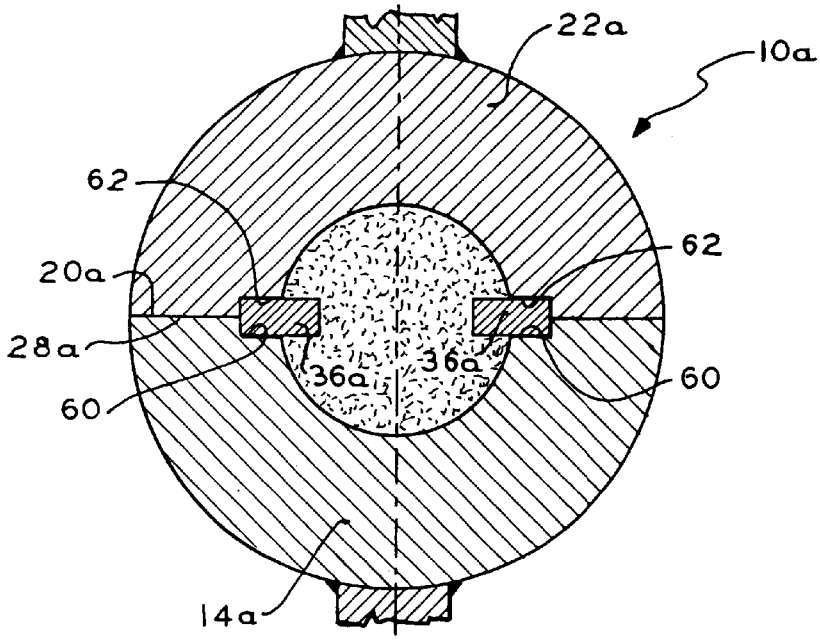
FIG. 2 is a vertical sectional view of a second preferred embodiment.

Said lower hemisphere 14 and said upper hemisphere 22 are coaxially aligned with each other along axis 12 and are mounted in opposition to each other so that equatorial surfaces 20,28 or complementary portions thereof, define an annular gap 30 therebetween. Said gap 30 has a gap distance 56. Inner surfaces 18,26 form a spherical cavity 32 which may contain a selective fill medium such as iron fill material 34 in order to augment the generated magnetic flux. As shown in FIGS. 1 and 2, assembly 10 receives an annular steel workpiece or ring 36, which is disposed in gap 30 when radial magnetization is to be applied thereto. Ring shaped workpiece 36 is coaxial with hemisphere 14,22 along axis 12.

Hemispheres 14,22 are two permanent magnet hemispheres which are identical in magnetization orientation but which are mounted in opposition such that the resulting equatorial magnetic field faces outward in the gap 30, as shown in FIG. 1. Alternatively, the magnetizations of the two permanent magnet hemispheres could be oriented in reverse so as to produce an equatorial magnetic field that faces inward. Hemispheres 14,22 have respective lower and upper toroidal flux line pathways or lines 38,40 which are curved flux paths through the cavity 32 between each hemisphere 14,22 and the gap 30, as shown in FIG. 1. Flux lines 38, 40 each has an axial component, and a radial component. Flux lines 38,40 are peripherally spaced about axis 12. Lower flux lines 38 extend upwardly from lower hemisphere 14 in a direction approximately parallel to axis 12, and then are directed radially outwardly from cavity 32 through the gap 30 approximately parallel to equatorial surfaces 20,28. Upper flux lines 40 extend downwardly from upper hemisphere 22 in a direction approximately parallel to axis 12, and then are directed radially outwardly from cavity 32 through the gap 30 approximately parallel to equatorial surfaces 20,28. When ring 36 is disposed in the gap 30, flux lines 38,40 then pass radially therethrough relative to axis 12. The directions of magnetization for both the top and bottom hemispheres of permanent magnet structure are shown by arrows 44 and 42, respectively.

Assembly 10 also comprises a jig 46 made of non-matallic material. Jig 46 includes a lower jig portion 48, which is connected to lower hemisphere 14 and an upper jig portion 50, which is connected to upper hemisphere 22. Fillet welds as shown in FIGS. 1 and 2 or threaded portions (not shown), or the like, may be utilized to connect jig portions 48,50 to respective hemispheres 14,22. Jig 46 also has an actuator (not shown) which is connected to lower and upper jig portions 48,50. The actuator can be an electro-mechanical or hydraulic type actuator. The jig 46 is adjustable in order to vary the size of gap 30. Specifically, jig 46 is used to adjust the size of gap 30 so that gap distance 56 approximately equals the thickness of workpiece ring 36.

Inner surfaces, 18,26 have a common inner radius 52. Other surfaces 16,24 also have a common outer radius 54. In the preferred embodiment, the ratio of outer radius 54 to inner radius 52 is about three.

FIG. 2 illustrates a second preferred embodiment, wherein equatorial surfaces **20*a*,28*a* each have a recess portion 60,62 respectively formed therein, which are radially located complementarily so as to accommodate a work-piece ring 36*a*. Lower hemisphere 14*a* and upper hemisphere 22*a* are mounted in opposition to each other with equatorial surfaces 20*a*,28*a* joined together in a flush relationship to each other, so that said recesses 60,62 form an annular slot within assembly 10*a*. Parts of second embodiment 10*a*, which correspond to parts of first embodiment 10**, have the same numerals but with a subscript "a" added thereto.

In operation, a ring 36 of a selective size can be placed on the lower hemisphere 14. Upper hemisphere 22 is lowered onto the top surface of ring 36 in order to attain a maximum radial magnetization field. A relatively large repulsive force between hemispheres 14,22 is overcome by jig 46. Lower jig portion 48 is preferably fixed in position, and upper jig portion 50 moves axially relative thereto.

A magnet with a remanence or magnetic induction of about 12 KG is used to magnetize ring 36. Given an outer-to-inner radius ratio of about three, in combination with iron fill material 34 disposed within cavity 32 to augment the flux generated by the magnet, an outward radial field at the ring 36 is well over 1.0T. After the ring 36 is magnetized, upper hemispheres 22 is raised and ring 36 is removed.

The magnetic field produced by assembly 10 can be varied either by a change in the outer-to-inner radius ratio or by changing the gap distance 56 of the preferred embodiment. Moreover, ring 36 could be magnetized in a radially inward direction by two permanent magnet hemispheres that are magnetized opposite to those of assembly 10 in FIG. 1.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A radial magnetizer, comprising:

an upper hemisphere and a lower hemisphere, each hemisphere being fabricated of permanent magnetic material about an axis to have inner and outer hemispherical surfaces with an equatorial surface disposed therebetween and magnetic flux passes at the inner hemispherical surface thereof; and the upper and lower hemispheres being coaxially aligned to form a sphere with a spherical cavity therein and with the magnetic flux of one hemisphere directed in opposition to the magnetic flux of the other hemisphere, while complementary portions of the equatorial surfaces are separated to establish an annular gap between the hemispheres and have complementary recesses therein for providing an annular slot to accommodate a work-piece ring, so that the radial magnetizer functions with the opposing magnetic flux of the hemispheres resulting in each flux path having an axial component through the spherical cavity and a radial component through the gap.

2. The magnetizer of claim 1 wherein a ring shaped work-piece is deposited in the annular slot to be radially magnetized relative to the axis.

3. The magnetizer of claim 1 wherein the flux paths pass radially outward in the gap relative to the axis.

4. The magnetizer of claim 1 wherein the flux paths pass radially inward in the gap relative to the axis.

5. The magnetizer of claim 1 wherein a jig of non-magnetic material retains the upper and lower hemispheres in coaxial alignment to form a sphere.

6. The magnetizer of claim 1 wherein the magnetic flux is augmented by disposing selective fill material in the cavity.

7. The magnetizer of claim 6 wherein the selective fill material is iron.

* * * * *